US005698802A

United States Patent [19]

Kamiya

[11] Patent Number: 5,698,802

[45] Date of Patent: Dec. 16, 1997

[54] MUSIC SYSTEM, TONE GENERATOR AND MUSICAL TONE-SYNTHESIZING METHOD

[75] Inventor: Ryo Kamiya, Hamamatsu, Japan

[73] Assignee: Yamaha Corporation, Japan

[21] Appl. No.: 659,018

[22] Filed: Jun. 4, 1996

[30] Foreign Application Priority Data

Jun. 7, 1995 [JP] Japan ..... 7-140813

[51] Int. Cl.[6] ..... G10H 7/00

[52] U.S. Cl. ..... 84/604; 84/602; 84/609; 84/622

[58] Field of Search ..... 84/602, 604–607, 84/609–610, 622–627, 601

[56] References Cited

U.S. PATENT DOCUMENTS

| | | | |
|---|---|---|---|
| 4,617,851 | 10/1986 | Sato | 84/1.19 |
| 5,119,710 | 6/1992 | Tsurumi et al. | 84/615 |
| 5,192,824 | 3/1993 | Shibukawa . | |
| 5,252,775 | 10/1993 | Urano | 84/645 |
| 5,376,750 | 12/1994 | Takeda et al. . | |

FOREIGN PATENT DOCUMENTS

| | | |
|---|---|---|
| 0 126 962 | 12/1984 | European Pat. Off. . |

*Primary Examiner*—William M. Shoop, Jr.
*Assistant Examiner*—Marlon T. Fletcher
*Attorney, Agent, or Firm*—Graham & James LLP

[57] ABSTRACT

A music system has a main system and a subsystem. The subsystem synthesizes musical tones, based on waveform data supplied from a cache memory as a temporary memory device, transfers waveform data stored in the cache memory in predetermined blocks to a tone generator according to progress of musical tone synthesization by the tone generator, sequentially stores next blocks of externally supplied waveform data in the cache memory at areas thereof which have become empty after the data transfer, and mixes together the musical tones synthesized by the tone generator and musical tones supplied from the main system. The main system includes a waveform memory and synthesizes musical tones, based on waveform data supplied from the waveform memory. The main system sequentially analyzes and processes performance data, synthesizes a musical tone when the main system is assigned to synthesize the musical tone, while it reads waveform data in the predetermined blocks from the waveform memory and transmits the same to the subsystem when the subsystem is assigned to synthesize a musical tone.

10 Claims, 7 Drawing Sheets

MUSIC SYSTEM, TONE GENERATOR AND MUSICAL TONE-SYNTHESIZING METHOD

BACKGROUND OF THE INVENTION

1. Field of the Invention

This invention relates to a music system, a tone generator, and a musical tone-synthesizing method which reproduce automatic performance data such as MIDI (Musical instrument Digital Interface) data.

2. Prior Art

Conventionally, a music system is known, which reads out automatic performance data such as MIDI data stored in a floppy disk or a hard disk, and synthesizes musical tones according to the automatic performance data, by the use of an FM (frequency modulation) tone generator or a WT (wave table) tone generator, to thereby produce musical sounds.

The conventional music system is comprised of a host system formed by a personal computer or the like, and a subsystem having a sound board connected to the host system via a predetermined interface. The host system operates on a program (program related to automatic performance) stored in a program memory to read performance data such as MIDI data from a hard disk or a floppy disk as external memory devices, and sends the read performance data to the sound board of the subsystem at predetermined timing.

On the other hand, the sound board includes a waveform memory (hereinafter referred to as "the wave table"), and a tone generator LSI which reads waveform data from the wave table according to the performance data sent from the host system. The sound board controls the envelope, amplitude, etc. of the waveform data, and converts the waveform data to an analog signal, which is then sounded by a sound system formed of an amplifier, a loudspeaker, etc.

In the conventional computer music system described above, however, all the functions relating to synthesization of musical tones are performed by the sound board. Therefore, a waveform memory having a large capacity is required to increase the number of tone colors to be generated, etc. leading to an increased cost. On the other hand, a personal computer forming the host system is generally provided with a large-capacity memory and external memory devices such as a floppy disk, a hard disk, and a CD-ROM.

A possible method to decrease the burden on the sound board may be to use the large-capacity memory and/or at least one of the external memory devices as a waveform memory and impart functions relating to synthesization of musical tones to the host system. According to this method, however, it is difficult to obtain musical tones having the same waveform and tone color between the host system and the subsystem, that is, obtain the same musical tone characteristics between the two systems. Further, the external memory devices have much lower access speeds than those of semiconductor memories and therefore cannot be satisfactorily used in practice as the waveform memory.

Even if the music system is used as a pure tone generator, a large-capacity memory is still required to store waveform data, also requiring use of external memory devices which are relatively inexpensive, as the waveform memory. These external devices, however, are not suitable for use in the music system as a pure tone generator, due to their much lower access speeds than that of a semiconductor memory.

SUMMARY OF THE INVENTION

It is an object of the invention to provide a music system, a tone generator and a musical tone-synthesization method which are capable of effectively utilizing a large-capacity memory of a host system thereof and reducing the memory capacity of a subsystem thereof, while obtaining the same musical tone characteristics between the host system and the subsystem.

It is another object of the invention to provide a music system, a tone generator and a musical tone-synthesization method which are capable of synthesizing musical tones even by the use of a large-capacity memory which has a low access speed.

To attain the above objects, there is provided a musical system including a main system and a subsystem. The main system includes a waveform memory for storing waveform data used in synthesizing musical tones, a musical tone synthesizer, and a performance data-processing device that sequentially analyzes and processes performance data. The subsystem includes a temporary cache memory device for storing externally supplied waveform data in predetermined blocks, a second musical tone synthesizing device, and a memory managing device for transferring waveform data stored in the cache memory to the second musical tone synthesizer. The performance data-processing device of the main system determines whether the first or second musical tone-synthesizing device is to be used to synthesize a musical tone based upon an analysis of the performance data. If the first musical tone synthesizing device is to be used, the performance data-processing device reads the waveform data from the waveform memory and supplies the data to the first synthesizing device. If, however, the second musical tone synthesizing device is to be used, the performance data-processing device reads the waveform data in predetermined blocks from the waveform memory and transmits the read waveform data to the subsystem for synthesizing.

With the above arrangement, only the main system is equipped with a large capacity waveform memory. Waveform data read from the waveform memory is transferred to the subsystem. Since the subsystem need not be equipped with a large capacity memory, costs are reduced. In addition, musical tone data are synthesized based upon waveform data stored in the waveform memory of the main system. Thus, musical tones synthesized by both the main system and the subsystem have similar tone color characteristics.

In an alternative embodiment of the present invention, a method for synthesizing musical tones is provided. The method is used in conjunction with a main system having a waveform memory and a first tone synthesizer and a subsystem having a temporary memory device and a second musical tone synthesizer. The method includes the step of sequentially analyzing and processive performance data indicative of musical tones to be performed. A first or second musical tone synthesizing device is assigned to synthesize a musical tone based upon the results of the performance data analysis. If the first tone synthesizer is chosen, the waveform data in the waveform memory is read out and supplied to the first synthesizer. If the second tone synthesizer is chosen, the waveform data in the waveform memory is read out in predetermined blocks and transmitted to the second tone synthesizer.

The above and other objects, features, and advantages of the invention will be more apparent from the following detailed description taken in conjunction with the accompanying drawings.

DETAILED DESCRIPTION

The invention will now be described in detail with reference to the drawings showing an embodiment thereof.

Figure 1:
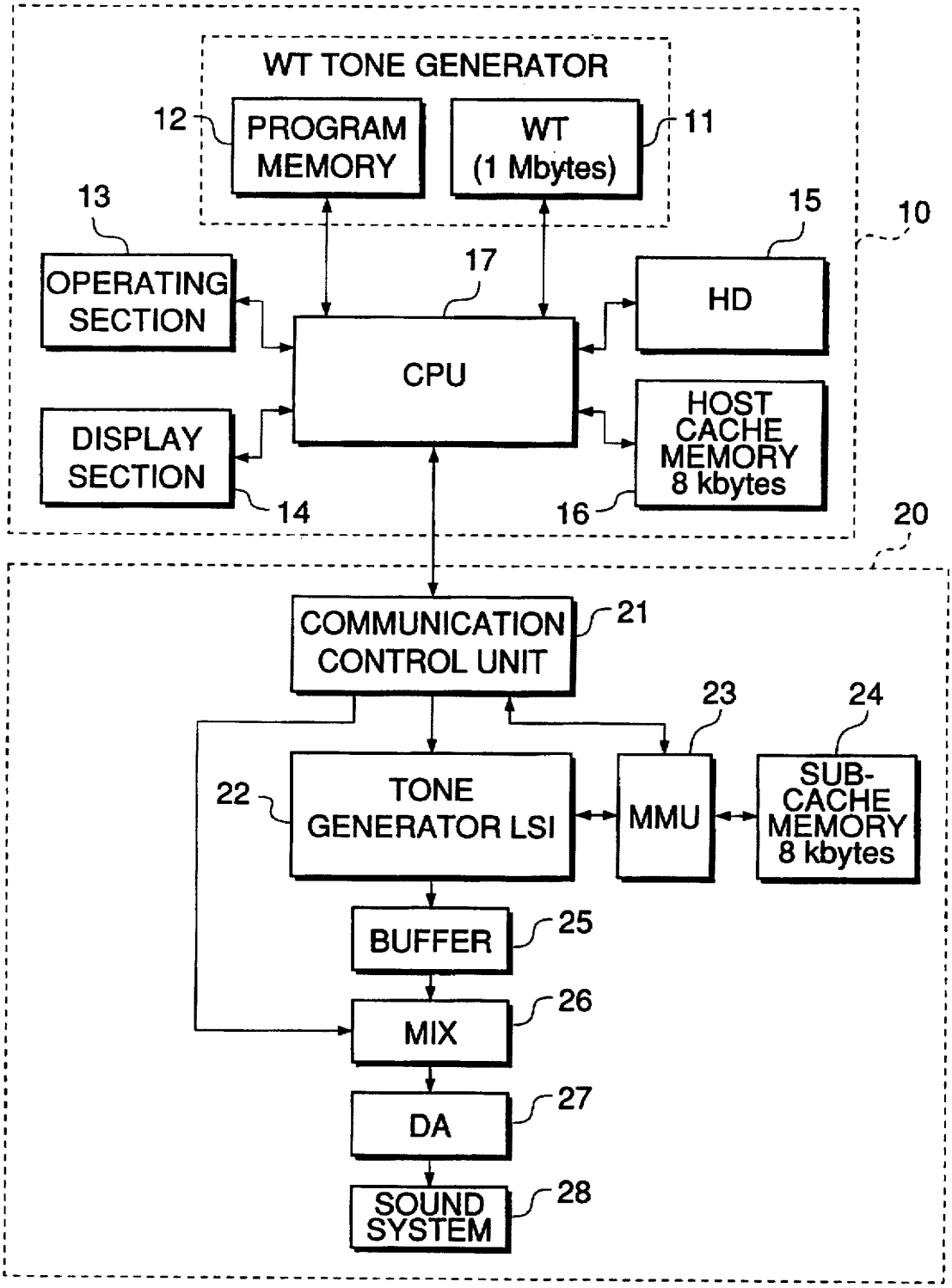
FIG. 1 is a block diagram schematically showing the arrangement of a computer music system as a music system according to an embodiment of the invention.

Referring first to FIG. 1, there is schematically illustrated the whole arrangement of a music system according to an embodiment of the invention. The music system according to the embodiment is comprised of a host computer 10, and a sound board 20 externally connected to the host computer 10. As shown in the figure, the host computer 10 is comprised of a wave table 11 which stores waveform data indicative of waveforms of musical tones, a program memory 12 which stores programs including a musical tone-synthesizing program for synthesizing musical tone data, an operating section 13, a display section 14, a hard disk 15, a host cache memory 16, and a CPU 17. The wave table 11 and the program memory 12 constitute a WT (wave table) tone generator. The wave table 11 is formed by a semiconductor memory having a large memory capacity (e.g. 1M bytes) and stores a plurality of waveform data. Alternatively of a semiconductor memory, the wave memory 11 may be an ordinary external memory device such as a floppy disk, a hard disk, and a CD-ROM.

The operating section 13 is comprised of a keyboard for compiling performance data, inputting data, and instructing operations, and panel switches for selecting operating modes of performance, tone colors of musical tones, etc. The display section 14 displays operating states and various kinds of information under the control of the CPU 17. The hard disk 15 stores performance data including MIDI data. An external memory device such as a floppy disk may be used in place of or together with the hard disk 15. The cache memory 16 has a memory capacity sufficient to store one block (e.g. 1 kilobytes) of waveform data per tone-generating channel, and serves as a buffer for temporarily storing waveform data to be sent to the sound board 20. Details of the function of the host cache memory 16 will be described hereinafter.

The CPU 17 operates on the musical tone-synthesizing program stored in the program memory 12 to determine whether musical tone data should be synthesized by the host computer 10 or by the sound board 20. When the CPU 17 determines that musical tone data should be synthesized by the host computer 10, it reads waveform data from the wave table 11 based on waveform data read from the hard disk 15, synthesizes musical tone data by imparting envelopes, etc. to the read waveform data, and sends the synthesized musical tone data to the sound board 20. On the other hand, when the CPU 17 determines that musical tone data should be synthesized by the sound board 20, it reads waveform data block by block from the wave table 11, temporarily stores the read waveform data in the host cache memory 16, and reads the data from the latter and sends the same to the sound board 20 upon receipt of a request for transfer of waveform data from the sound board 20. After transfer of one block of waveform data to the sound board 20, another or next block of waveform data is stored in the host cache memory 16.

The music system according to the present embodiment is adapted to simultaneously generate a plurality of musical tones. For example, four tone-generating channels are provided for the host computer 10, and eight tone-generating channels for the sound board 20. The sound board 20 is given priority over the host computer 10 to synthesize musical tone data. Therefore, which of the host computer 10 and the sound board 20 should synthesize musical tone data depends upon whether there is an empty tone-generating channel in the sound board 20. That is, when there is an empty tone-generating channel in the sound board 20, musical tone data is synthesized by the sound board 20, while when all the tone-generating channels in the sound board 20 are occupied, musical tone data is synthesized by the host computer 10.

The sound board 20 is comprised of a communication control unit 21, a tone generator LSI 22, a memory management unit 23, a sub-cache memory 24, a buffer 25, a mixer 26, and a D/A converter 27. The communication control unit 21 is disposed to receive waveform data and musical tone data from the host computer 10. When the communication control unit 21 receives waveform data from the host computer 10, it delivers the waveform data to the memory management unit (hereinafter referred to as the "MMU") 23, whereas when it receives musical tone data from the host computer 10, it delivers the same to the mixer 26. The MMU 23 once stores waveform data delivered from the communication control unit 21 in the sub-cache memory 24, then reads the waveform data from the memory 24 according to address data supplied from the tone generator LSI 22, and delivers the same to the tone generator LSI 22. This function of the MMU 23 will be described in detail hereinafter. The sub-cache memory 24 has a memory capacity sufficient to store one block (e.g. 1 kilobytes) of waveform data per tone-generating channel, similarly to the host cache memory 16.

The tone generator LSI 22 prepares address data for accessing the sub-cache memory 24, and if required, sends a request for transfer of the next block of waveform data to the host computer 10 via the communication control unit 21. The buffer 25 temporarily holds musical tone data synthesized by the tone generator LSI 22 in order to adjust a waiting time period for transfer of waveform data from the host computer 10 to the sub-cache memory 24 of the sound board 20. The mixer 26 mixes together musical tone data temporarily stored in the buffer 25 and musical tone data synthesized by the host computer 10 and delivered via the communication control unit 21, and delivers the mixed musical tone data to the D/A converter 27. The D/A converter 27 converts the mixed musical tone data to an analog signal, which is supplied to the sound system 28. The sound system 28, which is comprised of an amplifier and a loudspeaker, generates sound based on the analog musical tone signal. The sound system 28 may be either provided inside the sound board 20 or arranged outside the same.

Figure 2:
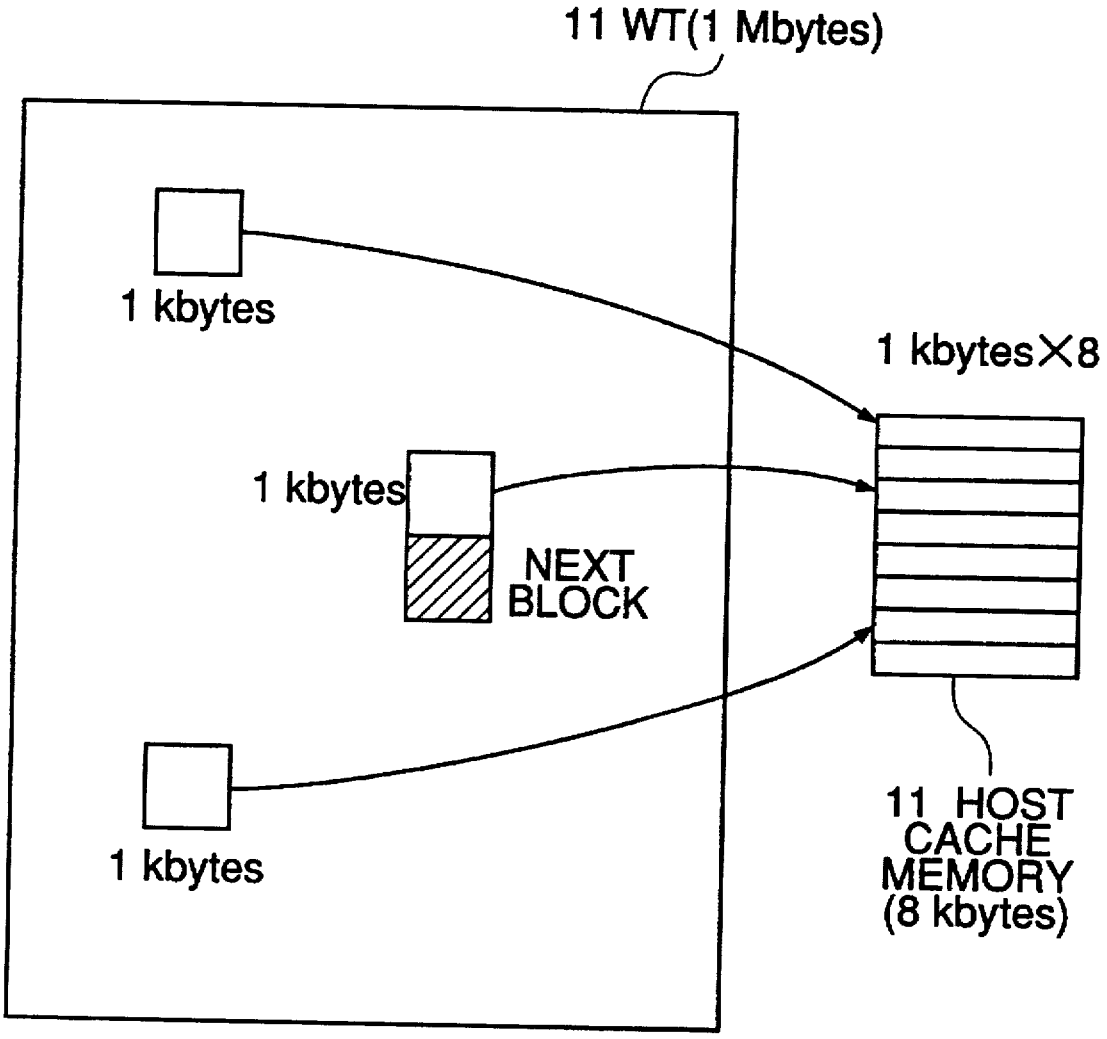
FIG. 2 is a conceptual representation useful in explaining the relationship between a wave table and a host cache memory which are employed in a host computer of the embodiment of FIG. 1.

FIG. 2 conceptually represents the functional relationship between the wave table 11 and the host cache memory 16, which are provided in the host computer 10. The wave table 11 stores waveform data, as stated before. The waveform data are read block by block from the wave table 11 and stored in the host cache memory 16 at areas thereof corresponding to respective predetermined tone-generating channels. The host cache memory 16 has a memory capacity corresponding to 8 channels (8 kilobytes). The waveform data stored in the host cache memory 16 is read and transferred to the sound board 20 at predetermined timing (timing of issuance of a request for transfer of the next block of data from the sound board 20), and then the next block of waveform data is stored in an area of the host cache memory 16 which has become empty due to the transfer. By thus providing cache areas for respective tone-generating channels, "cache mishit" can be reduced, and a block of waveform data to be read from the memory next time can be easily estimated.

Figure 3:
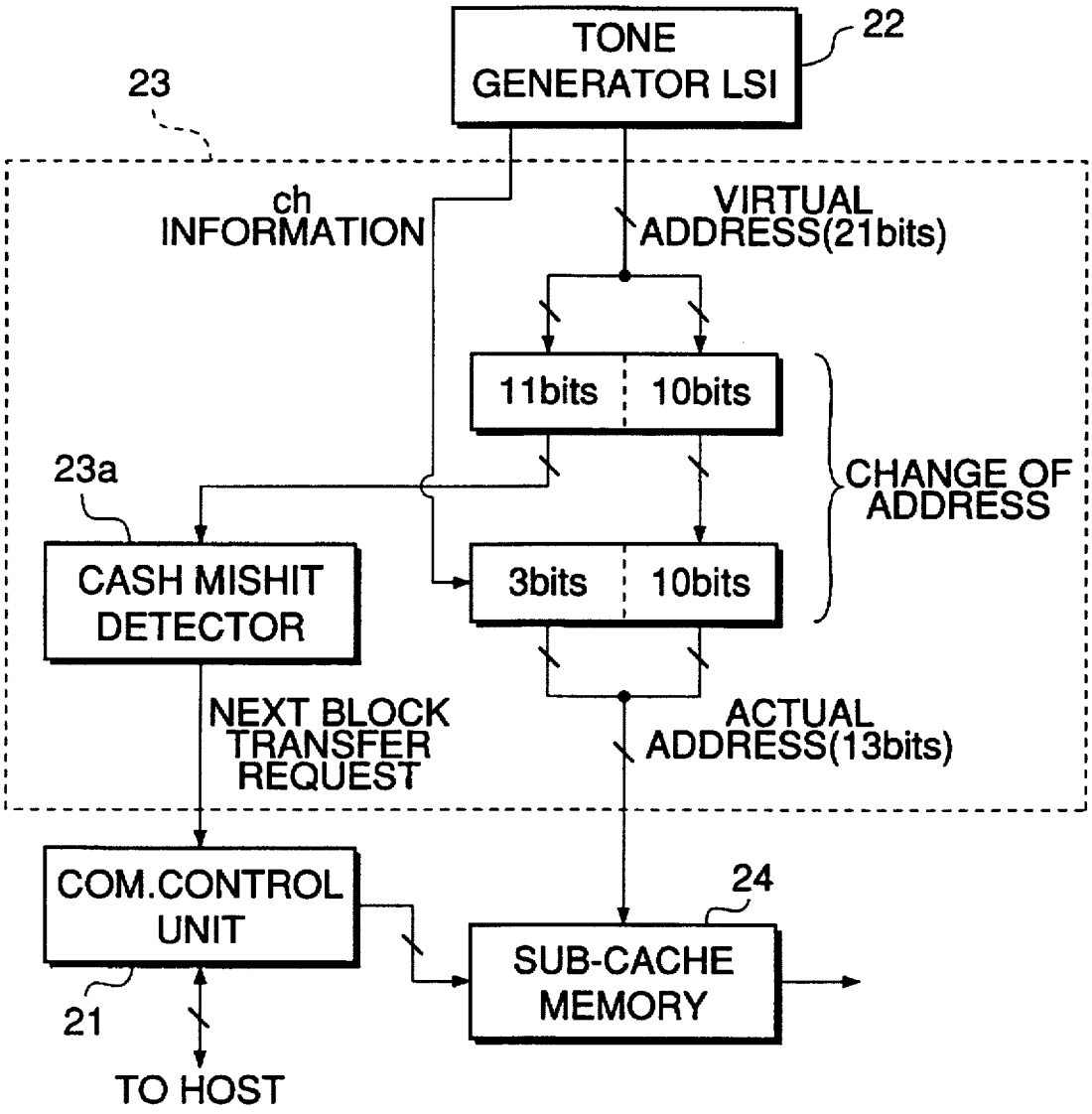
FIG. 3 is a block diagram schematically showing the arrangement of an MMU of a sound board employed in the FIG. 1 embodiment.

FIG. 3 conceptually represents the arrangement of the MMU 23 of the sound board 20. In the figure, the MMU 23 forms an actual address for accessing the sub-cache memory 24, based on 10 less significant bits of a virtual address (21 bits) delivered from the tone generator LSI 22 and 3-bit channel information delivered separately therefrom. More specifically, the MMU 23 designates an address of 1 kilobytes for accessing the sub-cache memory 24 based on the 10 less significant bits, and designates a tone-generating channel based on the 3 bits of the channel information as more significant bits. Conversion of the virtual address to the actual address can be carried out by the use of hardware such as registers or by the use of software. In this case, virtual addresses correspond to locations in a memory space of the CPU 17 (memory space of the host computer). A cache mishit detector 23*a* detects a cache mishit, based on 11 more significant bits of the virtual address, and sends a request for transfer of the next block of data, depending upon a result of the detection. The request is delivered to the host computer 10 via the communication control unit 21. A cash mishit occurs when the sub-cache memory 24 is accessed for waveform data not stored therein. Therefore, when the sub-cache memory 24 is accessed for the next block of waveform data immediately after completion of reading of 1 kilobytes of waveform data from the memory 24, a cache mishit occurs without exception, resulting in issuance of a request for transfer of the next block of waveform data.

The operation of the embodiment constructed as above will now be described, with reference to flowcharts of FIGS. 4 through 7.

Figure 4:
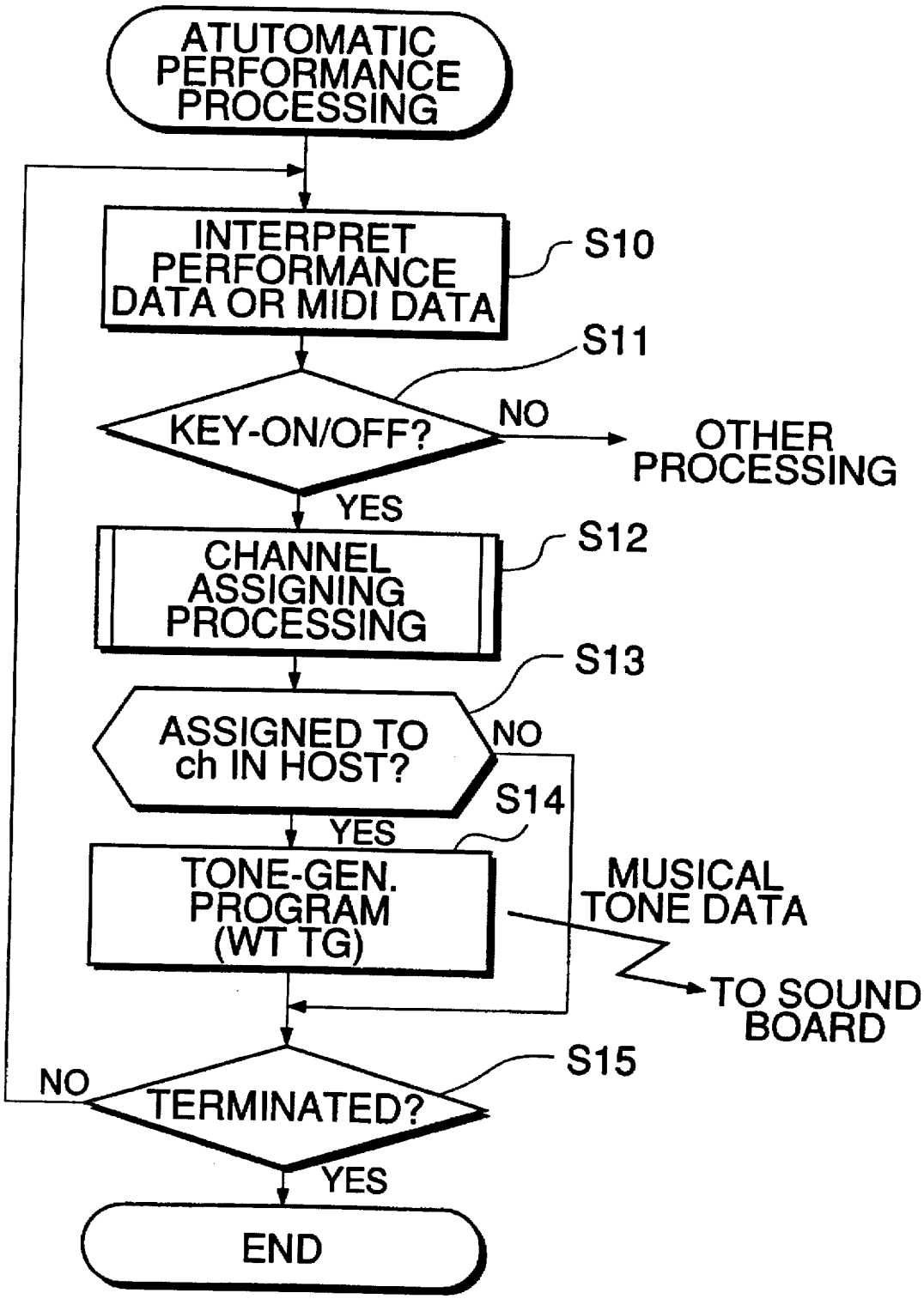
FIG. 4 is a flowchart showing a main routine for carrying out automatic performance processing, which is executed by the host computer of the music system according to the embodiment.

Referring first to FIG. 4 showing a main routine for carrying out automatic performance processing, which is executed by the host computer 10, first, at a step S10, the host computer 10 reads automatic performance data such as MIDI data stored in the hard disk 15 (or in the floppy disk) and interprets the read data. Then, at a step S11, it is determined whether the read automatic performance data indicates a key-on event or a key-off event. If the automatic performance data does not indicate a key-on event nor a key-off event, the answer to the question of the step S11 is negative (NO), and then the program proceeds to a step for executing processing related to the read data, not shown, description of which is omitted.

On the other hand, if the automatic performance data indicates a key-on event or a key-off event, the answer to the question of the step S11 is affirmative (YES), and then the program proceeds to a step S12. At the step S12, if the automatic performance data indicates a key-on event, tone-generating channel-assigning processing is carried out, wherein a key code of the data is assigned to a tone-generating channel through which a musical tone is to be generated. More specifically, if there is an empty channel in the sound board 20, the key code is assigned to the empty channel in the sound board 20 and the read waveform data is transferred to the host cache memory 16. On the other hand, if there is no empty channel in the sound board 20, the key code of the read performance data is assigned to a tone-generating channel in the host computer 10. Details of the tone-generating channel-assigning processing will be described hereinafter.

Then, at a step S13, it is determined whether or not the key code of the performance data has been assigned to a tone-generating channel in the host computer 10. If the key code has been assigned to a tone-generating channel in the sound board 20, the answer is negative (NO), and then the program proceeds to a step S15. On the other hand, if the key code has been assigned to a tone-generating channel in the host computer 10, the answer is affirmative (YES), and then the program proceeds to a step S14. At the step S14, the musical tone-generating program is started. More specifically, waveform data is read from the waveform table 11 according to the musical tone-generating program stored in the program memory 12, musical tone data is synthesized based on the read waveform data and transmitted to the sound board 20. Then, at the step S15, it is determined whether or not the automatic performance is to be terminated. If it is not to be terminated, the answer is negative (NO), and then the program returns to the step S10 to repeatedly execute the steps S10 to S15.

Figure 5:
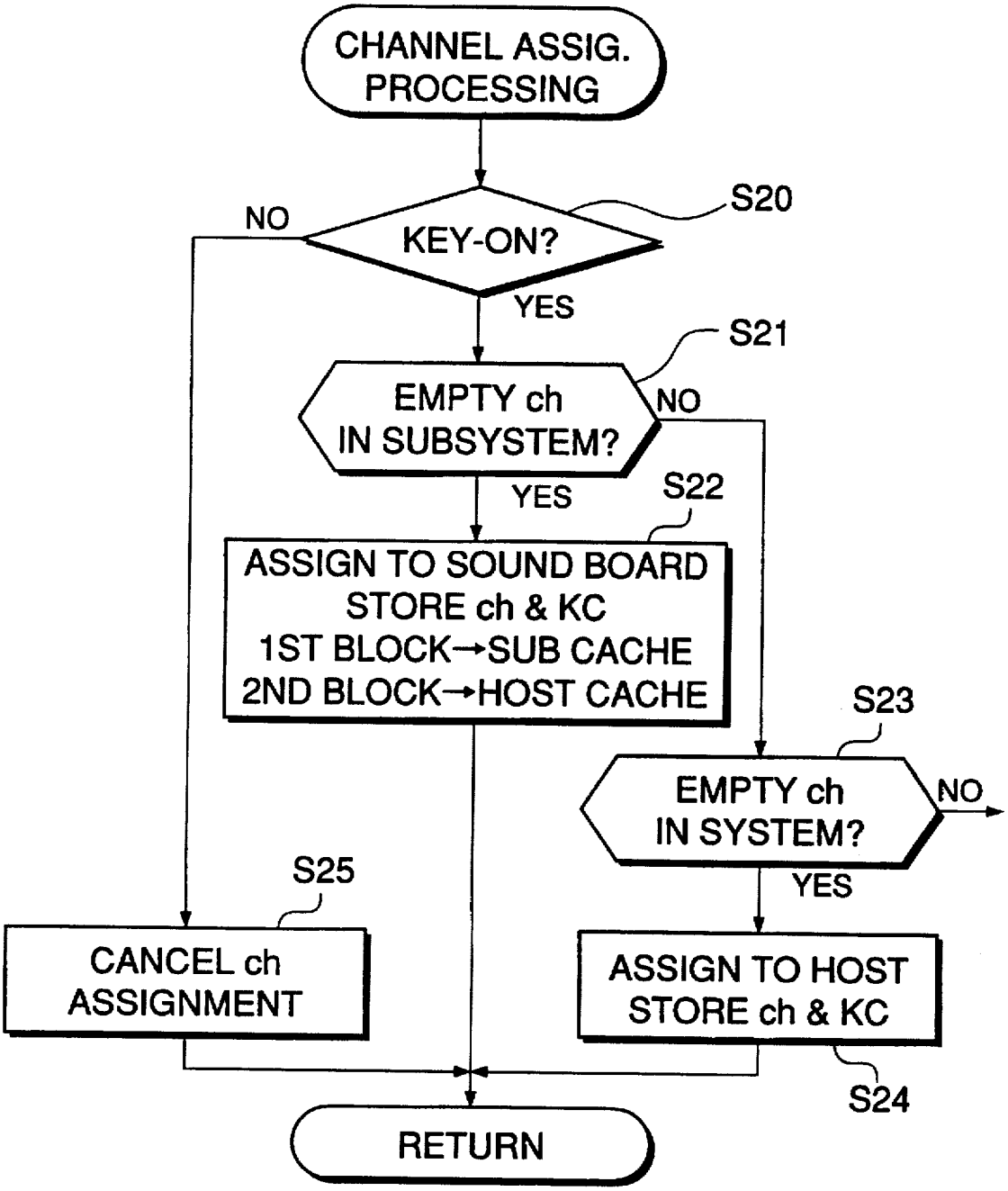
FIG. 5 is a flowchart showing a subroutine for carrying out tone-generating channel-assigning processing, which is executed by the host computer.

Details of the tone-generating channel-assigning processing will now be described. Referring to FIG. 5 showing a subroutine for carrying out tone-generating channel-assigning processing, which is executed by the host computer 10, first, at a step S20, the host computer 10 determines whether or not automatic performance data or MIDI data read at the aforesaid step S15 indicates a key-on event. If it indicates a key-on event, the program proceeds to a step S21, wherein it is determined whether or not there is an empty channel in the sound board 20 as a subsystem. If there is an empty channel in the sound board 20, the program proceeds to a step S22, wherein the key code of the read data is assigned to a tone-generating channel in the sound board 20, and the assigned channel (ch) and the key code (KC) are stored in a RAM, not shown. Further, a first block of waveform data is read from the waveform table 11 and the read waveform data is directly sent to the sound board 20. In the sound board 20, the first block of waveform data is stored in the sub-cache memory 24 at an area corresponding to the assigned tone-generating channel. Further, at the step S22, a second block of waveform data is read from the wave table 11 and stored in the host cache memory 16 at an area corresponding to a predetermined tone-generating channel. Then, the program returns to the aforedescribed main routine, followed by executing the step S13.

On the other hand, if there is no empty channel in the sound board 20, the answer to the question of the step S21 is negative (NO), and then the program proceeds to a step S23, wherein it is determined whether or not there is an empty channel in the host computer 10. If there is no empty channel in the host computer 10, that is, if all the channels in the sound board 20 and the host computer 10 are occupied, the answer to the question of the step S23 is negative (NO), and then the program proceeds to a step, not shown, wherein generation of a musical tone is inhibited, or a musical tone which is being generated but is decaying is stopped from being generated, to thereby secure an empty channel, to which the key code of the automatic performance data is assigned.

On the other hand, if there is an empty channel in the host computer 10, the answer to the question of the step S23 is affirmative (YES), and then the program proceeds to a step S24, wherein the key code of the automatic performance data is assigned to the empty channel in the host computer 10, and the assigned channel (ch) and the key code (KC) are stored in the RAM. Then, the program proceeds to the main routine, followed by executing the step S13. At the step S14 of the main routine, the host computer 10 synthesizes musical tone data, based on the assigned channel (ch) and the key code (KC), and the synthesized musical tone data is delivered to the sound board 20 at predetermined timing.

If the automatic performance data does not indicate a key-on event, that is, it indicates a key-off event, the answer to the question of the step S20 is negative (NO), and then the program proceeds to a step S25, wherein a tone-generating channel based on the key code (KC) and the assigned channel (ch) is released or made empty to thereby cancel the assignment. Then, the program returns to the main routine, followed by executing the step S13.

Figure 6:
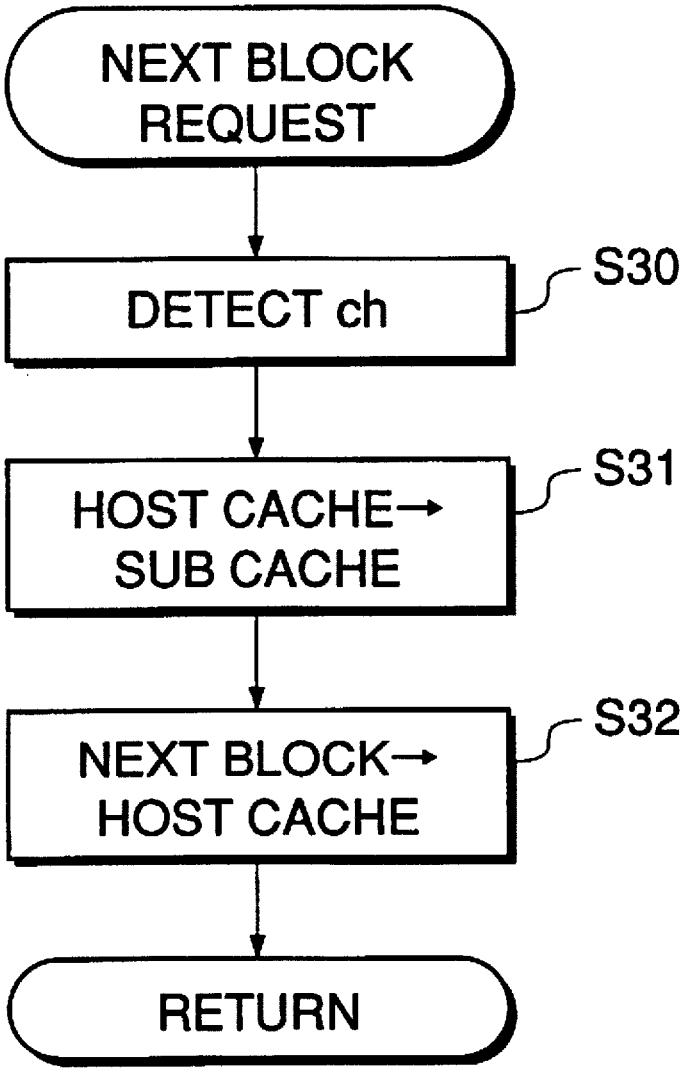
FIG. 6 is a flowchart showing a routine for carrying out processing upon receipt of a request for transfer of a next block of data, which is executed by the host computer.

Next, processing which is executed by the host computer upon receipt of a request for transfer of a next block of data will be described with reference to FIG. 6 showing a routine for carrying out the processing. When a cache mishit occurs upon accessing the sub-cache memory 24 of the sound board 20 for waveform data not stored therein (the next block of waveform data), a request for transfer of the next block of waveform data is issued from the sound board 20 and sent to the host computer 10, whereby the routine of FIG. 6 is executed. First, at a step S30, it is determined which tone-generating channel is to be used for generation of a musical tone based on the next block of waveform data. Then, at a step S31, waveform data (data of 1 kilobytes) is read from an area of the host cache memory 16 corresponding to the tone-generating channel and delivered to the sub-cache memory 24 of the sound board 20. Then, at a step S32, the next block of waveform data is read from the wave table 11 and stored in the host cache memory 16 at an area corresponding to the above tone-generating channel, followed by terminating the routine, whereby processing executed just before the issuance of the request for transfer of the next block of waveform data is resumed.

Figure 7:
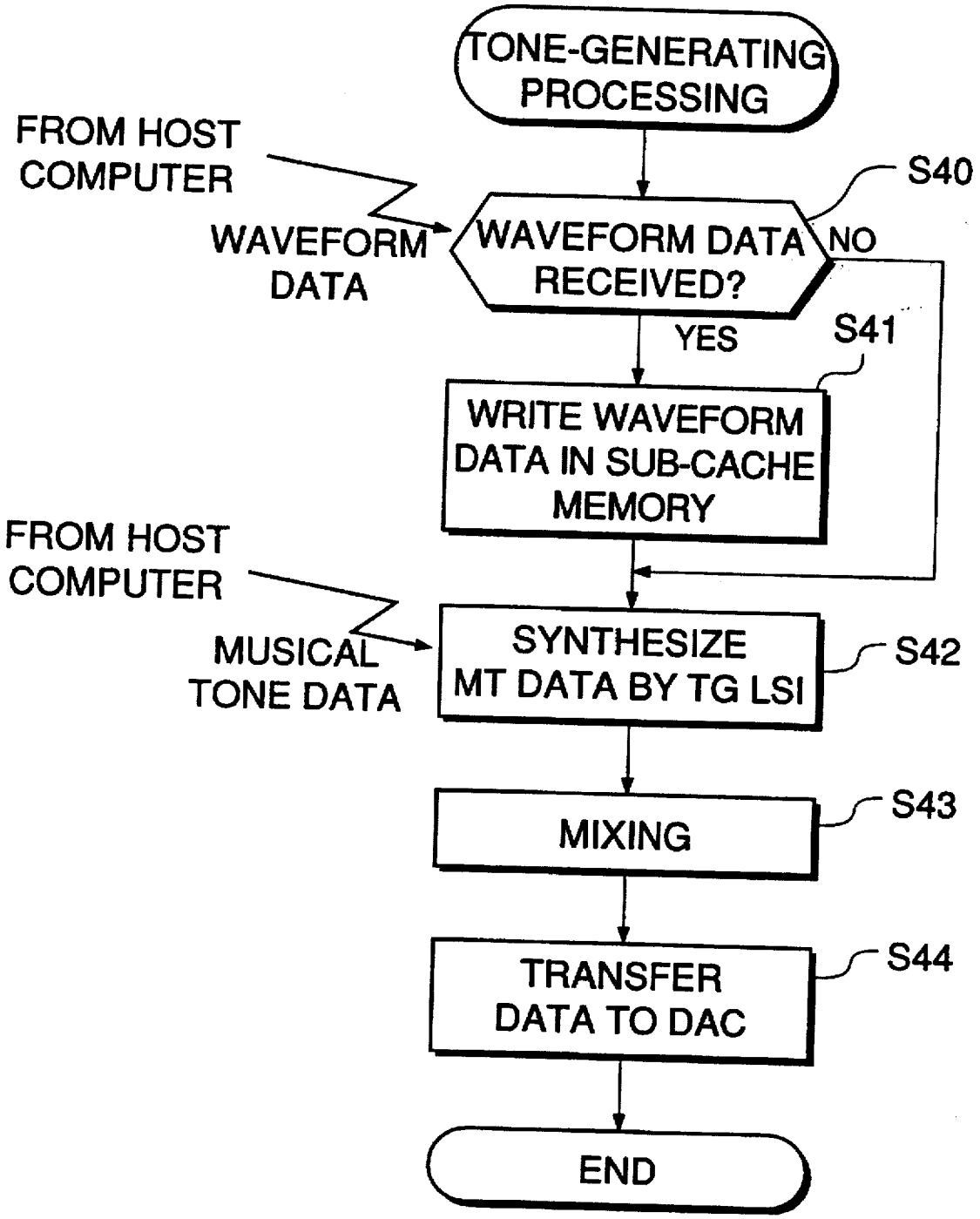
FIG. 7 is a flowchart showing a routine for generating musical tones, which is executed by a sound board of the music system according to the embodiment.

Next, the operation of the sound board 20 will be described with reference to FIG. 7 showing a routine for generating musical tones, which is executed by the sound board 20. Although the sound board 20 is usually constituted by hardware, the description will be made with reference to a flowchart shown in FIG. 7 for better understanding of the operation. First, in the sound board 20, it is determined at a step S40 whether or not waveform data has been received from the host computer 10. If waveform data has been received from the host computer 10, the answer is affirmative (YES), and then the program proceeds to a step S41, wherein the received waveform data is stored in the sub-cache memory 24 at an area corresponding to a predetermined tone-generating channel by the MMU 23. Then, at a step S42, waveform data are sequentially read from the sub-cache memory 24 and musical tone data are synthesized based on the read waveform data by the tone generator LSI 22.

Waveform data is delivered from the host computer 16 when a cache mishit occurs upon accessing the sub-cache memory 24 for waveform data not stored therein. If access is made to the sub-cache memory 24 for desired or next block of waveform data and the desired or next block of waveform data is not found, a request for transfer of the next block of waveform data is issued and sent to the host computer 10. The host computer 10 responds to the request by reading the next block of waveform data from the host cache memory 16 and transferring the same to the sound board 20, as described before. The MMU 23 of the sound board 20 stores the received waveform data in the sub-cache memory 24 at the area corresponding to the predetermined tone-generating channel at the steps S40 and S41. Therefore, the tone generator LSI 22 of the sound board 20 has only to synthesize musical tone data, based on waveform data sequentially read from the sub-cache memory 24 by the MMU 23, without being conscious of the transfer of waveform data from the host computer 10 to the sound board 20. The musical tone data synthesized by the tone generator LSI 22 is temporarily stored in the buffer 25.

Following the synthesization of musical tone data at the step S42, the synthesized musical tone data is mixed with musical tone data synthesized by the host computer 10 by the mixer 26 if the latter data has been transferred to the sound board 20. Then, at a step S44, the mixed musical tone data is delivered to the D/A converter 27, which in turn converts the mixed musical tone data to an analog signal, whereby a musical tone is generated by the loudspeaker of the sound system 28.

On the other hand, if no waveform data has been received from the host computer 10, the program jumps from the step S40 to the step S42, wherein musical tone data is synthesized based on waveform data already stored in the sub-cache memory 24. Then, similar operations to those described above are carried out at the steps S43 and S44.

Next, the operation of the overall music system according to the present embodiment will be described. The host computer 10 determines whether or not there is an empty tone-generating channel in the sound board 20 if the automatic performance data read from the external memory device indicates a key-on event or a key-off event. If there is an empty channel, the key code of the performance data is assigned to the empty tone-generating channel in the sound board 20. Then, whenever a request for transfer of the next block of waveform data is received from the sound board 20, one block of waveform data corresponding to a musical tone to be generated is read from the wave table 11, and the read block of waveform data is temporarily stored in the host cache memory 16 and then transferred to the sound board 20. Thus, waveform form data are sequentially transferred block by block from the host computer 10 to the sound board 20. The first block of waveform is directly transferred to the sub-cache memory 24 of the sound board 20. In the sound board 20, blocks of waveform data, each block being data of 1 kilobytes, sequentially transferred from the host computer 10 are sequentially stored in the sub-cache memory 24, based on which musical data are synthesized by the tone generator LSI 22. In reading waveform data from the sub-cache memory 24, when a cache mishit occurs, the sound board 20 sends a request for transfer of the next block of waveform data to the host computer 10.

On the other hand, so long as there is no empty tone-generating channel in the sound board 20, the host computer 10 sequentially reads waveform data from the wave table 11, synthesize musical tone data by means of the musical tone-generating program and delivers the synthesized musical tone data to the sound board 20.

In the sound board 20, musical tone data synthesized by the sound board 20 in the above described manner and the musical tone data synthesized by and delivered from the host computer 10 are mixed together, and the mixed musical tone data is converted to an analog signal by the D/A converter 27 to be sounded by the sound system 28.

As described above, according to the present embodiment, only the host computer 10 is provided with the large-capacity wave table 11 such that waveform data read from the wave table 11 are transferred to the sound board 20. As a result, the sound board 20 need not be provided with a large-capacity memory (wave table). Further, musical tone data are synthesized based on waveform data stored in the wave table 11 of the host computer 10 irrespective of whether the musical tone data are synthesized by the sound board 20 or by the host computer 10. As a result, musical tones synthesized by the host computer 10 and those synthesized by the sound board 20 can have the same tone color characteristics. Further, according to the present embodiment, only the sound board 20 has a tone-generating function, which can simplify the musical tone-synthesizing program executed by the host computer 10. Moreover, the host computer 10 carries out memory management of the wave table 11, which can simplify the memory management of the sound board 20. Besides, cache areas are provided respectively for the tone-generating channels, which decreases the frequency of occurrence of cache mishits and makes it possible to easily estimate a block of waveform data to be read from the memory next time.

In the above described embodiment, when musical tone-synthesizing means which synthesizes musical tones with higher priority, e.g. the sound board 20, has no empty tone-generating channel, other musical tone-synthesizing means, e.g. the host computer 10, synthesizes musical tones. However, this is not limitative. Alternatively of or together with the above arrangement, it may be arranged such that the two musical tone-synthesizing means operate in parallel so that the both means always synthesize musical tones. Further alternatively, it may be arranged such that the two means synthesize musical tones having respective different characteristics such as tone colors. In this alternative arrangement, a function of synthesizing simple musical tones such as rhythm sounds etc. may be allotted to a WT tone generator (host computer) which synthesizes musical tones by software. This is because a WT tone generator in general is suited for generating musical tones having such tone colors as can be generated simply by reading out PCM waveforms. On the other hand, musical tones (tone colors) requiring a complicated musical tone-synthesizing algorithm may be synthesized by the tone generator LSI.

Although in the above described embodiment, when a key code of automatic performance data is assigned to a tone-generating channel in the sound board 20, the first block of waveform data is directly transferred to the sub-cache memory 24 of the sound board 20 and the next or second block of waveform data is stored in the host cache memory 16, this is not limitative. Alternatively, for example, when a musical tone having a single tone color is to be generated, cancellation of the channel assignment at the step S25 in FIG. 5 is executed, and then the first block of waveform data is transferred to the sub-cache memory 24 and stored in an area thereof corresponding to an empty channel. According to this alternative method, synthesization of a musical tone by the sound board can be made earlier, which can simplify processing or hardware relating to tone-generating timing control.

What is claimed is:

1. A music system comprising:

a subsystem including a temporary memory device that stores externally supplied waveform data in predetermined blocks, a first musical tone-synthesizing device that synthesizes musical tones, based on said waveform data supplied from said temporary memory device, a memory-managing device that transfers said waveform data stored in said temporary memory device in said predetermined blocks to said first musical tone-synthesizing device according to progress of synthesization of musical tones by said first musical tone-synthesizing device, said memory-managing device sequentially storing next blocks of said externally supplied waveform data in said temporary memory device at areas thereof which have become empty after said transfer of said waveform data, and a mixing device that mixes together said musical tones synthesized by said first musical tone-synthesizing device and externally supplied musical tones; and a main system including a waveform memory that stores waveform data required for synthesization of musical tones, a second musical tone-synthesizing device that synthesizes musical tones, based on said waveform data supplied from said waveform memory, and a performance data-processing device that sequentially analyzes and processes performance data indicative of musical tones to be performed, said performance data-processing device determining which of said first musical tone-synthesizing device and said second musical tone-synthesizing device is to be assigned to synthesize a musical tone, depending upon results of said analyzing of performance data and according to a predetermined rule, said performance data-processing device reading said waveform data from said waveform memory and supplying the read waveform data to said second musical tone-synthesizing device when said second musical tone-synthesizing device is to be assigned to synthesize a musical tone, said performance data-processing device reading said waveform data in said predetermined blocks from said waveform memory and transmitting the read waveform data to said subsystem when said first musical tone-synthesizing device is to be assigned to synthesize a musical tone, wherein said musical tones synthesized by said second musical tone-synthesizing device are transmitted to said subsystem as said externally supplied musical tones.

2. A music system comprising:

a subsystem including a first temporary memory device that stores externally supplied waveform data in predetermined blocks, a first musical tone-synthesizing device that synthesizes musical tones, based on said waveform data supplied from said first temporary memory device, a memory-managing device that transfers said waveform data stored in said first temporary memory device in said predetermined blocks to said first musical tone-synthesizing device according to progress of synthesization of musical tones by said first musical tone-synthesizing device and then issues a request for transfer of a next block of waveform data, said memory-managing device sequentially storing next blocks of said externally supplied waveform data, which are each supplied in response to said request for transfer of said next block of waveform data, in said first temporary memory device at areas thereof which have become empty after said transfer of said waveform data, and a mixing device that mixes together said musical tones synthesized by said first musical tone-synthesizing device and externally supplied musical tones; and a main system including a waveform memory that stores waveform data required for synthesization of musical tones, a second temporary memory device that is substantially identical in construction with said first temporary memory device, a second musical tone-synthesizing device that synthesizes musical tones, based on said waveform data supplied from said waveform memory, and a performance data-processing device that sequentially analyzes and processes performance data indicative of musical tones to be performed, said performance data-processing device determining which of said first musical tone-synthesizing device and said second musical tone-synthesizing device is to be assigned to synthesize a musical tone, depending upon results of said analyzing of performance data and according to a predetermined rule, said performance data-processing device reading said waveform data from said waveform memory and supplying the read waveform data to said second musical tone-synthesizing device when said second musical tone-synthesizing device is to be assigned to synthesize a musical tone, said performance data-processing device reading said waveform data in said predetermined blocks from said waveform memory and storing the read waveform data in said second temporary memory device when said first musical tone-synthesizing device is to be assigned to synthesize a musical tone, said performance data-processing device transferring said waveform data stored in said second temporary memory device whenever said request for transfer of said next block of waveform data is received and storing waveform data subsequently read from said waveform memory in said second temporary memory device, wherein said musical tones synthesized by said second musical tone-synthesizing device are transmitted to said subsystem as said externally supplied musical tones.

3. A music system as claimed in claim 1, wherein said second musical tone-synthesizing device synthesizes musical tones, based on said performance data, when said first musical tone-synthesizing device reaches a limit of processing capacity thereof.

4. A music system as claimed in claim 1, wherein said first musical tone-synthesizing device and said second musical tone-synthesizing device operate in parallel to synthesize musical tones, based on said performance data.

5. A music system as claimed in claim 4, wherein said first musical tone-synthesizing device and said second musical tone-synthesizing device synthesize musical tones having respective different characteristics.

6. A music system as claimed in claim 1, wherein said first musical tone-synthesizing device synthesizes musical tones by hardware.

7. A music system as claimed in claim 1, wherein said temporary memory device is higher in access speed than said waveform memory.

8. A music system as claimed in claim 2, wherein said first and second temporary memory devices are higher in access speed than said waveform memory.

9. A tone generator comprising:

a waveform memory that stores waveform data required for synthesization of musical tones;

a temporary memory device that stores said waveform data in predetermined blocks, said temporary memory device being higher in access speed than said waveform memory;

a musical tone-synthesizing device that synthesizes musical tones, based on said waveform data supplied from said waveform memory; and a memory-managing device that transfers said waveform data stored in said temporary memory device in said predetermined blocks to said musical tone-synthesizing device according to progress of synthesization of musical tones by said musical tone-synthesizing device, said memory-managing device sequentially storing next blocks of said waveform data read from said temporary memory device at areas thereof which have become empty after said transfer of said waveform data.

10. A method for synthesizing musical tones in a musical system having a main system including a waveform memory that stores waveform data and a first musical tone-synthesizing device that synthesizes musical tones based on said waveform data supplied from said waveform memory, and a subsystem including a temporary memory device that stores externally supplied waveform data in predetermined blocks a second musical tone-synthesizing device that synthesizes musical tones based on said waveform data supplied from said temporary memory device a memory-managing device that transfers said waveform data stored in said temporary memory device in said predetermined blocks to said first musical tone-synthesizing device and a mixing device that mixes together said musical tones synthesized by said first musical tone-synthesizing device and said first musical tone synthesizing device, said method comprising the steps of:

sequentially analyzing and processing performance data indicative of musical tones to be performed;

determining which of said first musical tone-synthesizing device and said second musical tone-synthesizing device is to be assigned to synthesize a musical tone, depending upon results of said analyzing of performance data and according to a predetermined rule;

reading said waveform data from said waveform memory and supplying the read waveform data to said first musical tone-synthesizing device when said first musical tone-synthesizing device is to be assigned to synthesize a musical tone; and reading said waveform data in said predetermined blocks from said waveform memory and transmitting the read waveform data to said subsystem when said second musical tone-synthesizing device is to be assigned to synthesize a musical tone.

* * * * *